US012336574B2

(12) United States Patent
Lin

(10) Patent No.: US 12,336,574 B2
(45) Date of Patent: Jun. 24, 2025

(54) BREAST SHAPING DEVICE

(71) Applicant: Zigan Lin, Shenzhen (CN)

(72) Inventor: Zigan Lin, Shenzhen (CN)

( * ) Notice: Subject to any disclaimer, the term of this patent is extended or adjusted under 35 U.S.C. 154(b) by 0 days.

(21) Appl. No.: 18/890,219

(22) Filed: Sep. 19, 2024

(65) Prior Publication Data

US 2025/0009048 A1 Jan. 9, 2025

(51) Int. Cl.
*A41C 3/14* (2006.01)

(52) U.S. Cl.
CPC ..... *A41C 3/144* (2013.01)

(58) Field of Classification Search
CPC ..... A41C 3/144
USPC ..... 450/54, 38
See application file for complete search history.

(56) References Cited

U.S. PATENT DOCUMENTS 76,894 A * 4/1868 Cook ..... A41C 3/105 450/38
2,579,365 A * 12/1951 Conde ..... A41C 3/10 D2/706
2,844,151 A * 7/1958 Lemons ..... A41C 3/10 450/80
3,280,818 A * 10/1966 Pankey ..... A41C 3/065 450/81
3,326,218 A * 6/1967 McAlpine ..... A41C 3/105 450/38
5,347,656 A * 9/1994 Fabritz ..... A41C 3/105 450/38
5,755,611 A * 5/1998 Noble ..... A41C 3/065 450/39
5,833,515 A * 11/1998 Shahbazian ..... A41C 3/105 450/38
6,080,037 A * 6/2000 Lee ..... A41C 3/105 450/38
6,302,760 B1 * 10/2001 Dai ..... A41C 3/105 450/38
6,461,221 B1 * 10/2002 Stilwell ..... A41C 3/0007 450/38
6,743,073 B1 * 6/2004 Tsai ..... A41C 3/144 450/57
6,758,720 B2 * 7/2004 Chen ..... A41C 3/065 450/57
6,780,081 B2 * 8/2004 Chen ..... A41C 3/065 450/54
7,407,429 B2 * 8/2008 Chen ..... A41C 3/065 450/81
7,942,722 B2 * 5/2011 Tseng ..... B32B 5/245 450/38

(Continued)

*Primary Examiner* — Gloria M Hale
(74) *Attorney, Agent, or Firm* — Hemisphere Law, PLLC; Zhigang Ma

(57) ABSTRACT

The present disclosure discloses a breast shaping device, including a saccus unit and an elastic pad unit. The saccus unit includes a saccus and an inflation and deflation assembly; the elastic pad unit is arranged at the saccus; a radian of a surface, close to the breast side, of the saccus after inflation is limited to be less than a radian of the other side away from the breast. The present disclosure uses the saccus unit to cooperate with the elastic pad unit to limit the shape, so that the pressure after the inflation faces one side, which not only reduces the phenomenon of empty cups in the bra, but also allows the breasts to be concentrated and lifted, showcasing the individuation of a user.

13 Claims, 8 Drawing Sheets

(56) References Cited

U.S. PATENT DOCUMENTS

| | | | | |
|---|---|---|---|---|
| 8,105,129 | B2 * | 1/2012 | Chen | A41C 3/105 450/38 |
| 8,727,830 | B2 * | 5/2014 | Fleeton | A41C 3/105 450/38 |
| 9,011,201 | B2 * | 4/2015 | Chen | A41C 3/065 450/86 |
| 9,107,457 | B2 * | 8/2015 | Wang | A41C 3/148 |
| 9,468,236 | B1 * | 10/2016 | Sherry | A41C 3/105 |
| 9,713,350 | B1 * | 7/2017 | Colburn | A41C 3/065 |
| 10,986,881 | B2 * | 4/2021 | Stanton | A41C 3/0064 |
| 2008/0125675 | A1 | 5/2008 | Lalonde | |
| 2013/0109276 | A1 * | 5/2013 | Sporn | A41C 3/10 450/57 |
| 2014/0221879 | A1 | 8/2014 | Chu | |
| 2020/0155302 | A1 | 5/2020 | Visconti | |

* cited by examiner

BREAST SHAPING DEVICE

TECHNICAL FIELD

The present disclosure relates to the field of bras, and in particular, to a breast shaping device.

BACKGROUND

Referring to FIG. 1, an existing shaping bra 1 disclosed in the prior art is shown, which includes a bra 11, a pump 12, an air inlet valve 13, a pair of saccuses 14, a pair of channels 15, and an air release valve 16. The bra 11 is provided with a center 111, a pair of cups 112 extending oppositely from the center 111 and configured to wrap the breasts (not shown) of a user, and a pair of side wings 113 connected to the corresponding cups 111.

The pump 12 is communicated to the air inlet valve 13 and is arranged at the center 111 of the bra 11. The pair of channels 15 is located at the center 111 of the bra 11, is communicated to the air inlet valve 13, and extend oppositely. Each saccus 14 is provided with a plurality of air chambers 141 communicated to the respective corresponding channels 15, and each cup 112 arranged at the bra 11. The air release valve 16 is arranged at the center 111 of the bra 11 and is communicated to the saccus 14. During actual use, a user can directly press the pump 12 to allow air to pass through the air inlet valve 13 and reach the air chambers 141 of the saccuses 14 through the channels 15 for inflation and expansion, so that the user enhances and adjusts the visual effect of the saccuses 14 according to the sizes of the breasts of the user and a need of the user. However, gaps between the air chambers 141 after expansion may pinch the surfaces of the breasts, causing traces of use and affecting the aesthetics and comfort.

According to the technical content mentioned above, there is still a room for improvement in the structure of the shaping bra.

SUMMARY

To solve the defects and shortcomings in the prior art, the present disclosure aims to provide a breast shaping device capable of shaping the breasts and improving the aesthetics and comfort.

To achieve the above objectives, the present disclosure provides the following technical solutions:

A breast shaping device is designed to be placed inside a bra of a user and is in contact with the breasts next to the bra. The breast shaping device includes:

- a saccus unit, including a saccus, and an inflation and deflation assembly communicated to the saccus; and further includes an elastic pad unit. The elastic is arranged on one side of the saccus adjacent to the breasts, and a radian of a surface, close to the breast side, of the saccus after inflation is limited to be less than a radian of the other side away from the breasts.

The elastic pad unit includes a pair of elastic pads spaced apart from each other on the saccus.

Each elastic pad is a thin foam sheet.

Each elastic pad is a hollow double-layer fabric.

Each elastic pad is provided with an attachment region on one side facing the breasts, and an air guide region surrounding the attachment region; a plurality of convex ribs spaced apart from each other and protruding and extending towards the breast are arranged on the air guide region of each elastic pad; and a trench is defined between two adjacent convex ribs.

The saccus of the saccus unit is provided with a first piece body and a second piece body abutted with the first piece body; the second piece body is close to the breasts relative to the first piece body for the attachment of the pair of elastic pads; the first piece body and the second piece body jointly define a pair of inflation spaces spaced apart from each other and corresponding to the breasts, and a pair of channels respectively communicated to the respective corresponding inflation spaces and located between the breasts; the saccus is connected to the inflation and deflation assembly; and the inflation and deflation assembly of the saccus unit are located between the breasts and is provided with an air inlet pump and the air inlet valve which are communicated to the pair of channels and are communicated to each other, and an air release valve communicated to the saccus.

The saccus is further provided with a breathable fabric; and the breathable fabric covers and fixes the second piece body of the saccus and wraps the elastic pads.

The saccus of the saccus unit is provided with a pair of saccus bodies spaced apart from each other at the breasts; the saccus bodies are defined with inflation spaces; the saccus is connected to the inflation and deflation assembly; the inflation and deflation assembly of the saccus unit is provided with a pair of air inlet pumps, a pair of air inlet valves, and a pair of air release valves; the air inlet pumps are communicated to the respective corresponding air inlet valves and are arranged on the respective corresponding saccus bodies to inflate the inflation spaces of the respective corresponding saccus bodies; and the air release valves are arranged on the respective corresponding saccus bodies and are communicated to the inflation spaces of the respective corresponding saccus bodies.

The saccus of the saccus unit is provided with a pair of saccus bodies spaced apart from each other at the breasts; each saccus body defines an inflation space and channel which are communicated to each other; the inflation and deflation assembly of the saccus unit is provided with an air inlet pump and an air inlet valve which are communicated to each other, and a pair of air release valves; the air release valves are arranged in the channels of the respective corresponding saccus bodies; the air inlet pump and air inlet valve of the saccus unit independently inflate the respective corresponding inflation spaces through the channels of the saccus bodies; and after the inflation spaces are filled with air, the inflation spaces are closed by the respective corresponding air release valves.

The saccus bodies are provided with first piece bodies and second piece bodies abutted with the first piece bodies; the second piece bodies are close to the respective corresponding breasts relative to the respective corresponding first piece bodies for the attachment of the respective corresponding elastic pads; and the first piece bodies and the second piece bodies jointly define the respective corresponding inflation spaces.

The saccus bodies are provided with first piece bodies and second piece bodies abutted with the first piece bodies; the second piece bodies are close to the respective corresponding breasts relative to the respective corresponding first piece bodies for the attachment of the respective corresponding elastic pads; and the first piece bodies and the second piece bodies jointly define the respective corresponding inflation spaces.

The saccus is further provided with a breathable fabric; and the breathable fabric covers and fixes the second piece bodies of the saccus bodies and wrap the elastic pads.

According to the breast shaping device of the present disclosure, the breast shaping device further includes a plurality of air holes arranged at a bottom edge of the saccus.

The present disclosure has the beneficial effects: The saccus unit cooperates with the elastic pad unit to limit the shape, so that the pressure after the saccus is inflated faces one side, which can reduce the phenomenon of the empty cups in the bra to enhance the shaping effect of the breasts highlight the personal style of a user, and enhance the interest and fun in use.

To explain the structural features and effects of the present disclosure more clearly, the present disclosure will be described in detail below in conjunction with the accompanying drawings and specific embodiments.

DETAILED DESCRIPTION OF THE EMBODIMENTS

The technical solutions in the embodiments of the present disclosure are clearly and completely described below with reference to the accompanying drawings. Apparently, the described embodiments are merely preferred embodiments of the present disclosure.

It should be noted that when an element is referred to as being "fixed to" another element, the element can be directly on another component or there can be a centered element. When an element is considered to be "connected" to another element, the element can be directly connected to another element or there may be a centered element. The terms "vertical", "horizontal", "left", "right", and similar expressions used herein are for illustrative purposes only and do not necessarily represent the only implementation.

Unless otherwise defined, all technical and scientific terms used herein have the same meaning as those commonly understood by a person skilled in the art to which the present disclosure belongs. The terms used in this specification of the present disclosure are merely intended to describe objectives of the specific implementations, but are not intended to limit the present disclosure. The term "and/or" used herein includes any and all combinations of one or more related listed items.

The present disclosure will be described in detail below with reference to the accompanying drawings and embodiments.

Figure 1:
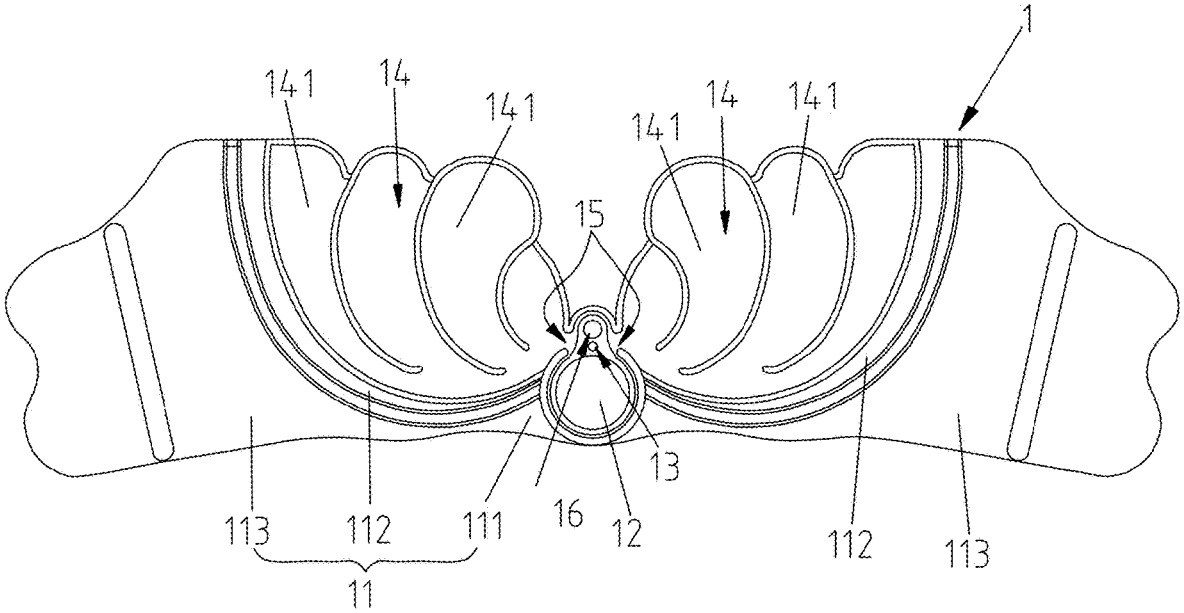
FIG. 1 (Prior Art)
FIG. 1 is a shaping bra disclosed in the prior art.
Figure 2:
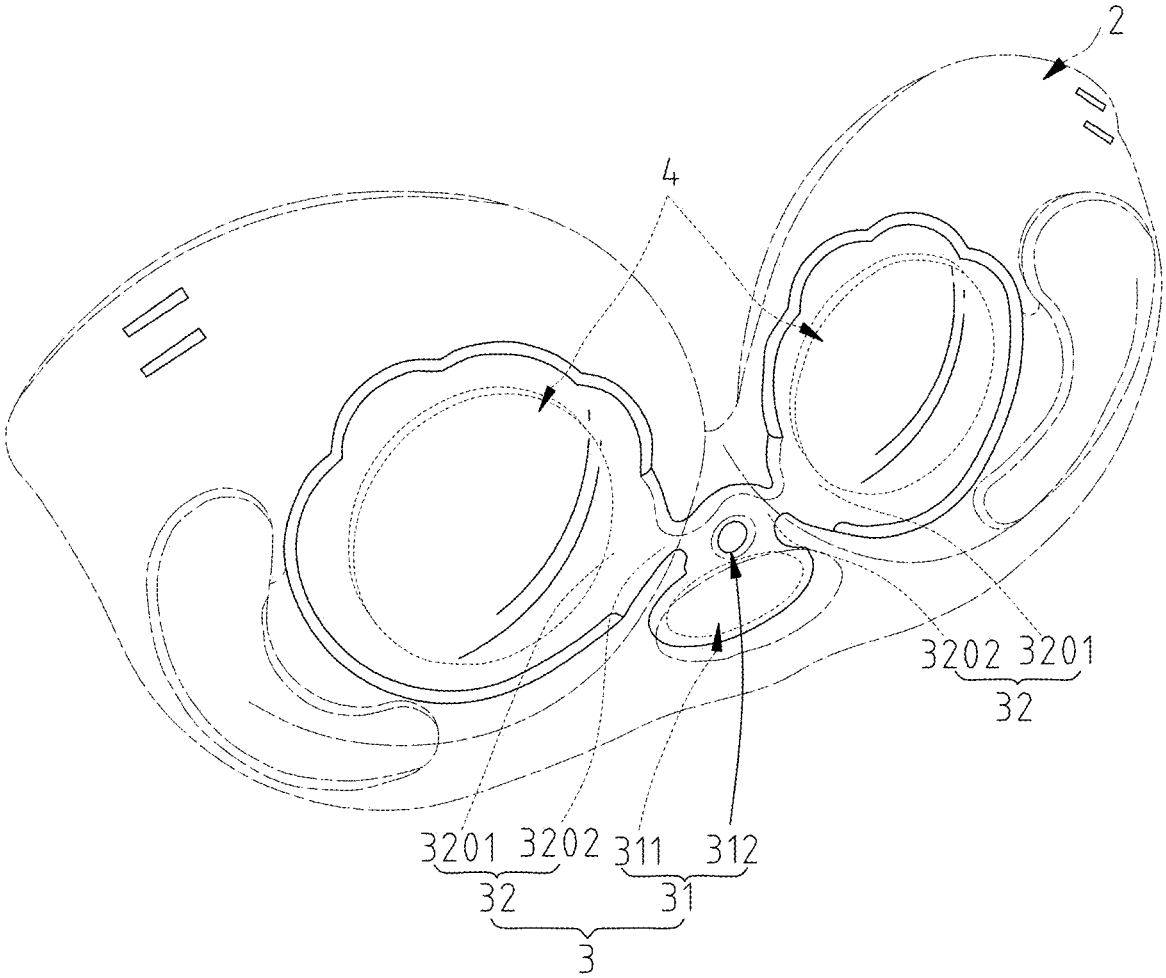
FIG. 2 is a three-dimensional combination diagram, indicating a first embodiment of a breast shaping device of the present disclosure.
Figure 3:
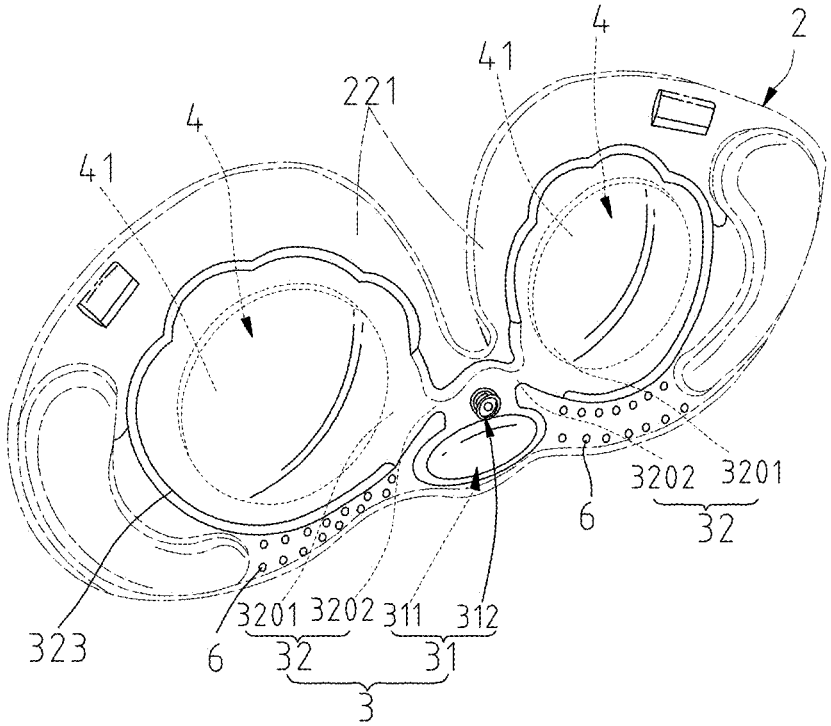
FIG. 3 is a three-dimensional exploded diagram, indicating a detail structure of the first embodiment of the present disclosure.

Referring to FIG. 2 and FIG. 3, in a first embodiment, a breast shaping device of the present disclosure is designed to be placed inside a bra 2 of a user and is in contact with a breast 9 next to the breast shaping device. The breast shaping device of the first embodiment of the present disclosure includes a saccus unit 3 and an elastic pad unit.

The saccus unit 3 includes a saccus 32, and an inflation and deflation assembly 31 communicated to the saccus 32.

The elastic pad unit is arranged on one side of the saccus 32 adjacent to the breast 9, and a radian of an inflated surface of the saccus 32 close to the breast side is limited to be less than the other side away from the breast 9. Preferably, the elastic pad unit includes a pair of elastic pads 4 spaced apart from each other on the saccus 32. When the saccus 32 is inflated, the elastic pads 4 will define a bearing surface 41 together with the saccus. Even better, each elastic pad 4 is a thin foam sheet or a hollow double-layer fabric.

As shown in FIG. 3 to FIG. 6, the saccus 32 of the saccus unit 3 is provided with a first piece body 321 and a second piece body 322 abutted with the first piece body. The second piece body 322 is close to the breast 9 relative to the first piece body 321 for the attachment of the pair of elastic pads 4; the first piece body 321 and the second piece body 322 jointly define a pair of inflation spaces 3201 spaced apart from each other and correspondingly located at the breasts 9, and a pair of channels 3202 respectively communicated to the respective corresponding inflation spaces 3201 and located between the breasts 9; the saccus 32 is connected to the inflation and deflation assembly 31; and the inflation and deflation assembly 31 of the saccus unit 3 are located between the breasts 9 and is provided with an air inlet pump 311 and an air inlet valve (not shown) which are communicated to the pair of channels 3202 and are communicated to each other, and an air release valve 312 communicated to the saccus 32. Specifically, the second piece body 322 is limited by the elastic pads 4. Therefore, after the saccus 32 is inflated, the expansion radian of the first piece body 321 can be greater than that of the second piece body 322, and the second piece body 322 has an effect of fitting the breast 9.

Preferably, the breast shaping device of the first embodiment of the present disclosure further includes a plurality of air holes 6 provided at a bottom edge of the saccus 32. The saccus 32 is further provided with a breathable fabric 323; and the breathable fabric 323 covers and fixes the second piece body 322 of the saccus 32 and wraps the elastic pads 4.

Figure 4:
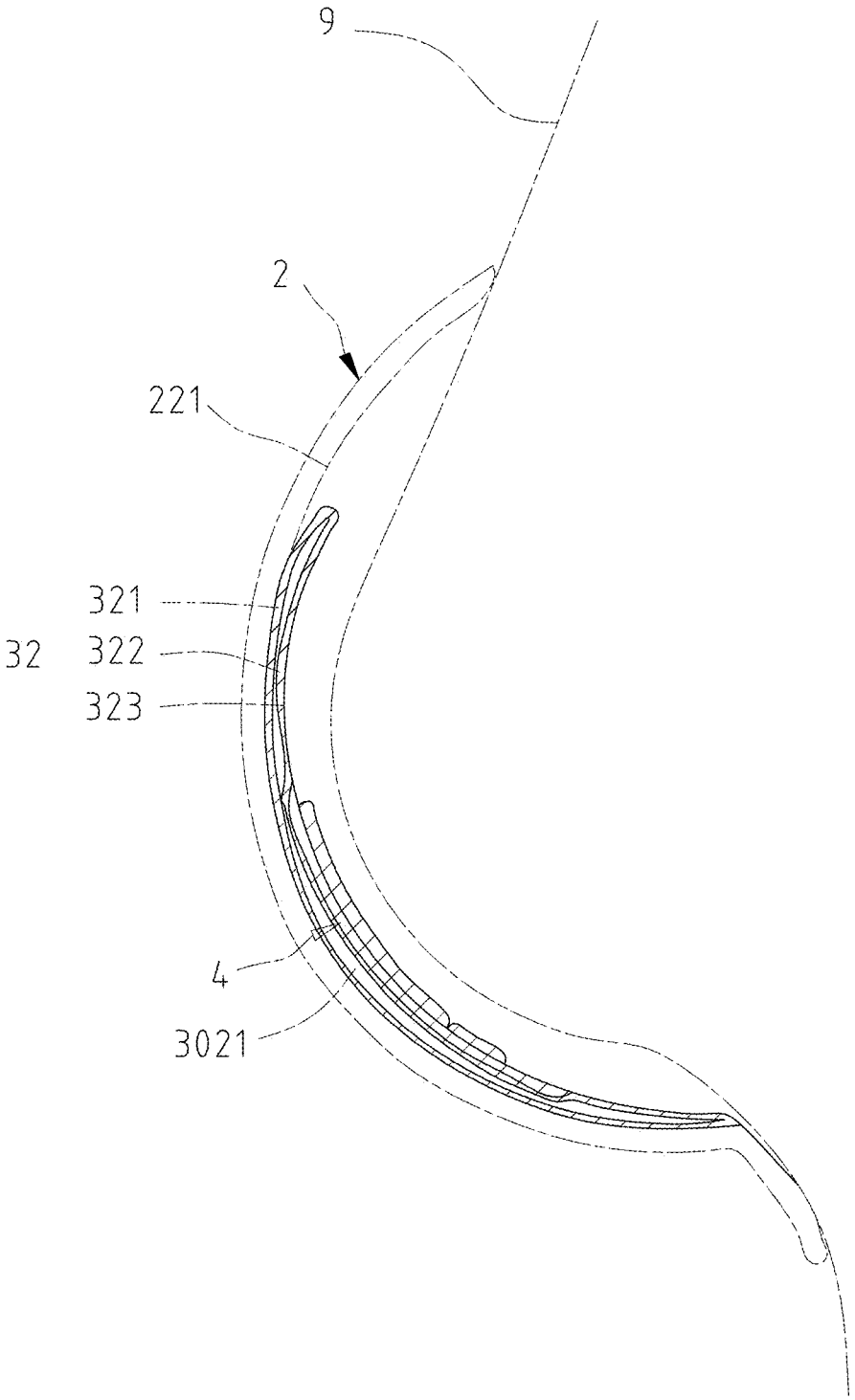
FIG. 4 is a sectional diagram, indicating a use state of the first embodiment of the present disclosure before inflation.
Figure 5:
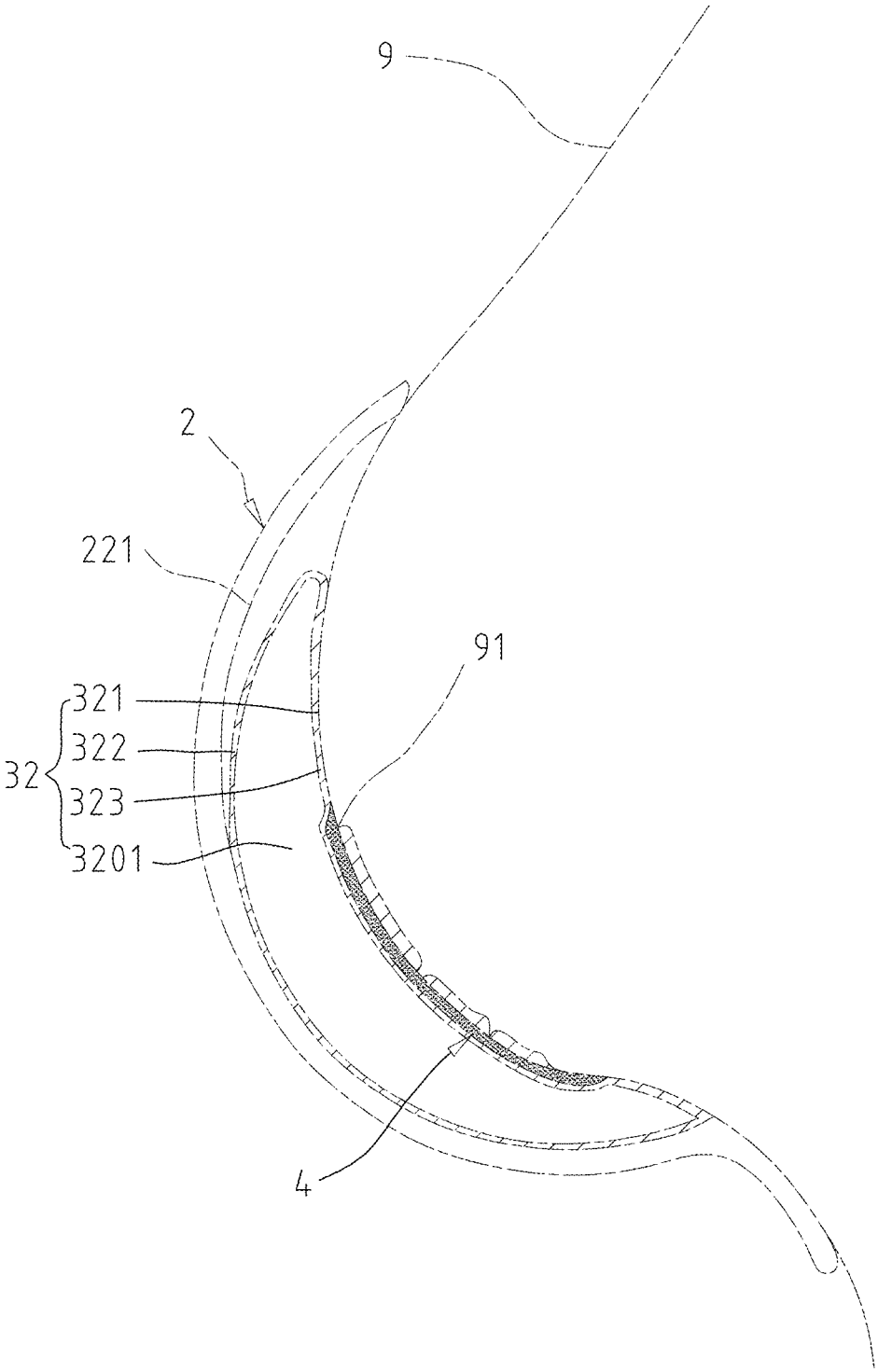
FIG. 5 is a sectional diagram, indicating a use state of the first embodiment of the present disclosure after inflation.

Referring to FIG. 3 to FIG. 5, during actual use, a user can directly press the air inlet pump 311 located between the breasts 9 to inflate the inflation spaces 3201 through the channels 3202 of the saccus 32. After the inflation, the inflation spaces 3201 will narrow the spaces in two cup regions 221 of the bra 2. The second piece body 322 of the saccus 32 will also expand towards the breasts 9 to push the breathable fabric 323 of the saccus 32 to move towards the breasts 9.

As mentioned above, it can be seen that in the first embodiment of the present disclosure, by the cooperation of the saccus unit 3 and the elastic pads 4, the spaces in the cup regions 221 of the bra 2 can be narrowed due to the limitation of the elastic pads 4 on the saccus unit 3, so that the shaping amount of the breasts 9 is relatively increased because of the narrowing of the spaces in the cup regions 221 that can be occupied by the inflation spaces 3201 of the inflated saccus 32, which can highlight the personal style of a user. For example, before inflation of each inflation space 3201, surface areas of the saccus 32 located on two opposite sides (namely the side with the first piece body 321 and the side with the second piece body 322) of the cup region 221 are both 100% (see FIG. 4). After inflation, as the saccus 32 expands, the surface area on the side with the first piece body 321 is reduced to 67%, and the surface reduction degree of the side of the saccus 32 that is in contact with the elastic pad 4 (namely the second piece body 322 with the elastic pad 4) may be relatively less than the non-contact side (namely the side with the first piece body 321). Therefore, a larger contact area can be provided for the breasts 9 of a user and the respective corresponding elastic pads 4 for supporting and fixing.

It should be noted here that the saccus unit 3 of the first embodiment of the present disclosure is only illustrated by the structure shown in FIG. 3 (namely, the inflation and deflation assembly 31 has a single group of air inlet pumps 311, air inlet valve, and air release valve 312 located between the breasts 9, and the inflation space 3201 and channel 3202 of the saccus 32 are paired in a bilateral symmetry manner, so that the inflation space 3201 and the channel 3202 can share the single group of air inlet pumps 311, air inlet valve, and air release valve 312), but the saccus unit is not limited to this. For example, a configuration relationship between the aforementioned inflation and deflation assembly 31 and the saccus 32 can be described below.

Figure 6:
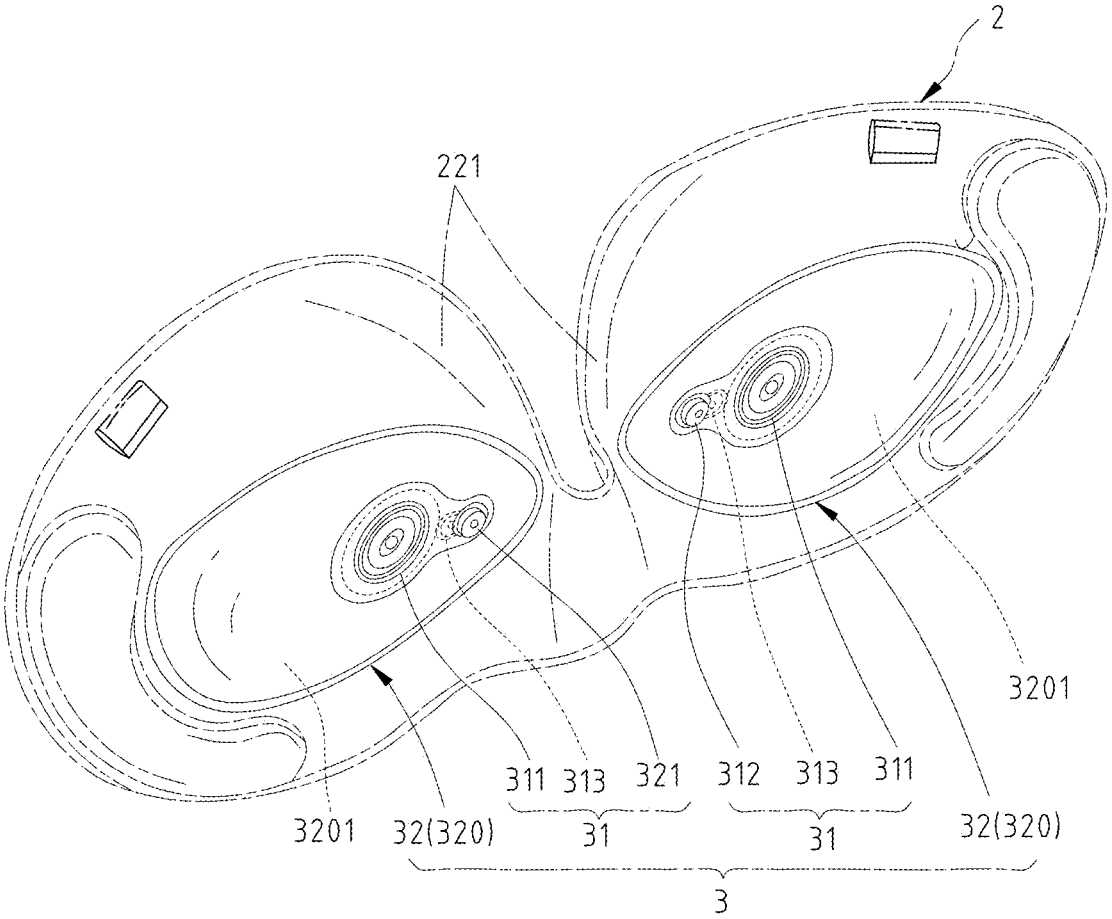
FIG. 6 is a three-dimensional diagram, indicating another implementation of a saccus unit of the first embodiment of the present disclosure.

Referring to FIG. 6, the saccus 32 of the saccus unit 3 is provided with a pair of saccus bodies 320 spaced apart from each other at the breasts 9 (not shown in the figure). Each saccus body 320 defines an inflation space 3201, and the saccus 32 is connected to the inflation and deflation assembly 31. Specifically, the inflation and deflation assembly 31 of the saccus unit 3 is provided with a pair of air inlet pumps 311, a pair of air inlet valves 313, and a pair of air release valves 312. These air inlet pumps 311 are communicated to the respective corresponding air inlet valves 313 and are arranged on the respective corresponding saccus bodies 320 to inflate the inflation spaces 3201 of the respective corresponding saccus bodies 320; and the air release valves 312 are arranged on the respective corresponding saccus bodies 320 and are communicated to the inflation spaces 3201 of the respective corresponding saccus bodies 320.

For the saccus unit 3, in addition to the structure as shown in FIG. 6, the saccus 32 of the saccus unit 3 may be alternatively provided with the pair of saccus bodies 320 spaced apart from each other at the breasts 9 (not shown) in FIG. 6. Each saccus body 320 defines the inflation space 3201 and a channel which are communicated to each other; the inflation and deflation assembly 31 of the saccus unit 3 is provided with an air inlet pump and an air inlet valve which are communicated to each other, and a pair of air release valves (not shown); the air release valves are arranged in the channels of the respective corresponding saccus bodies 320; the air inlet pump and air inlet valve of the saccus unit 3 independently inflate the respective corresponding inflation spaces 3201 through the channels of the saccus bodies 320; after the inflation spaces 3201 are filled with air, the inflation spaces 3201 are closed by the respective corresponding air release valves. Specifically, in practical use, an external connecting pipe (not shown) can be used to connect the channels of the saccus bodies 320 with the air inlet valve, so that the connecting pipe can be independently connected to the inflation spaces 3201 and separately inflate the inflation spaces 3201 through the air inlet pump.

From the structural configuration of the saccus unit 3 described in the above two paragraphs, the saccus bodies 320 are also provided with the first piece bodies 321 and second piece bodies 322 abutted with the first piece bodies (refer to FIG. 4 and FIG. 5); the second piece bodies 322 are close to the respective corresponding breasts 9 relative to the respective corresponding first piece bodies 321 for the attachment of the respective corresponding elastic pads 4; and the first piece bodies 321 and the second piece bodies 322 jointly define the respective corresponding inflation spaces 3201. The first piece bodies 321 and the second piece bodies 322 protrude towards the breasts 9 in the same direction. In this way, after the saccus bodies 320 are inflated, the second piece bodies 322 can achieve the effect of fitting the respective corresponding breasts 9. Similarly, the saccus 32 of the saccus unit 3 described in the above two paragraphs is further provided with a breathable fabric 323; and the breathable fabric 323 covers and fixes the second piece bodies 321 of the saccus bodies 320 and wrap the elastic pads 4, so that the embossing parts 5 are attached to the surfaces of the breathable fabric.

Figure 7:
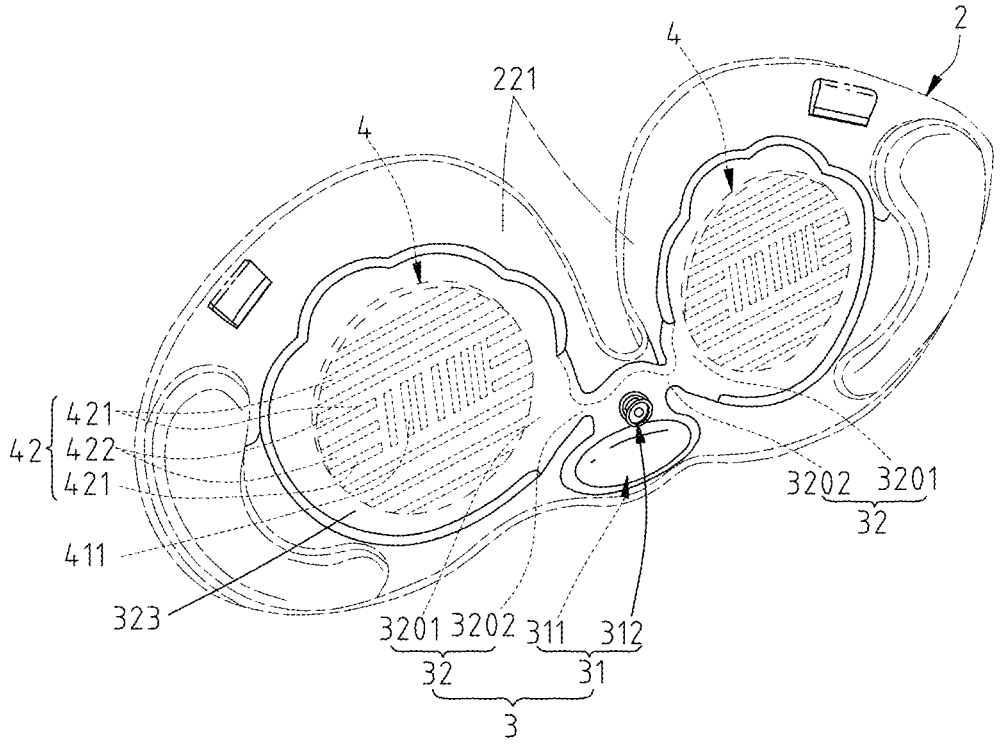
FIG. 7 is a three-dimensional exploded diagram, indicating a second embodiment of a breast shaping device of the present disclosure.
Figure 8:
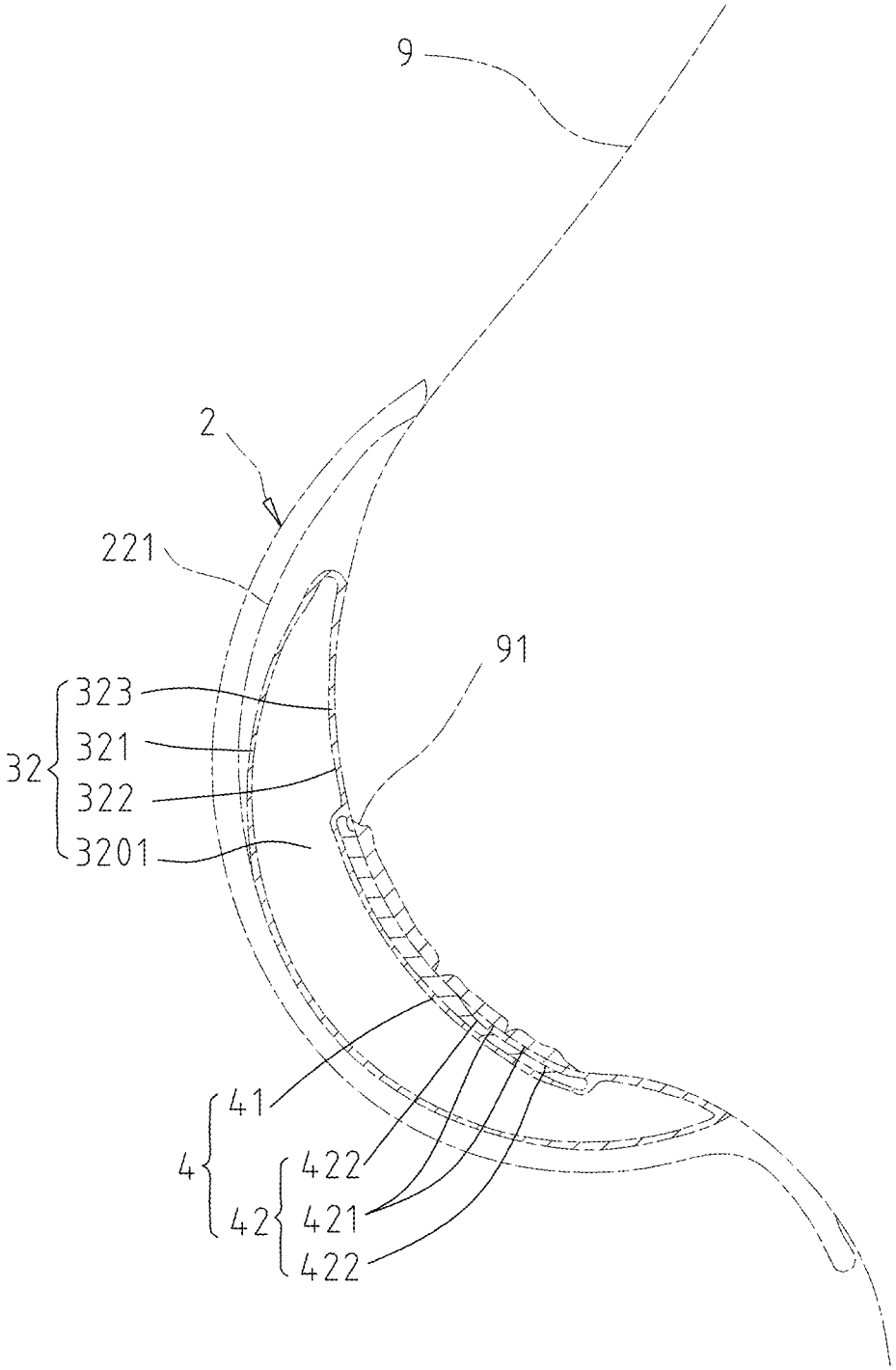
FIG. 8 is a sectional diagram, indicating a use state of the second embodiment of the present disclosure after inflation.

Referring to FIG. 7 and FIG. 8, the second embodiment of the breast shaping device of the present disclosure are roughly the same as the first embodiment. A difference is that each elastic pad 4 of the second embodiment of the present disclosure is provided with an attachment region 411 located on one side facing the breast 9 and at the bearing surface 41, and an air guide region 42 surrounding the attachment region 411. A plurality of convex ribs 421 spaced apart from each other and protruding and extending towards the breast 9 are arranged on the air guide region 42 of each elastic pad 4; and a trench 422 is defined between two adjacent convex ribs 421. The positions of the attachment regions 411 of the elastic pads 4 correspond to the positions of the embossing parts 5, and the convex ribs 421 that constitute the air guide region 42 and the air guide region 42 of the channels 422 have an air guide function, which can reduce the discomfort caused by stuffiness when a user wears the bra, and the corresponding breasts can be wrapped more effectively through this structure.

In detail, in the second embodiment of the present disclosure, the attachment regions 411 of the elastic pads 4 are attached to the second piece bodies 322 of the saccus 32. Furthermore, the convex ribs 421 and the trenches 422 of the elastic pads 4 can reduce the discomfort caused by the stuffiness when a user wears the bra. Compared with the first embodiment, the thicknesses of the convex ribs 421 of the elastic pads 4 can be used to push the saccus 32 to move, thereby narrowing the spaces in the cup regions 221 of the bra 2. The shaping amount of the breasts 9 is relatively increased due to a further decrease in the spaces of the cup regions 221 occupied by the inflation spaces 3201 of the inflated saccus 32. Therefore, the supporting effect, the fixing effect, and the shaping amount of the second embodiment of the present disclosure are relatively better than those of the first embodiment.

It should be noted that the elastic pads 4 can be arranged on the inner or outer side of the saccus 32 according to a manufacturing requirement, as long as it can achieve that the inflation and expansion of the second piece bodies 322 of the saccus 32 are limited. This is not limited to the disclosure of the current embodiments.

In summary, the breast shaping device of the present disclosure can use the elastic pads 4 to limit the shape after the inflation and expansion of the second piece bodies 322 of the saccus 32, so as to enhance the shaping effect of the breasts 9 and highlight the personal style of the user and enhance the interest and fun of use. Therefore, the objectives of the present disclosure can be achieved in deed.

The above only describes the embodiments of the present disclosure. When the scope of implementation of the present disclosure cannot be limited by this, any simple equivalent changes and modifications made according to the claims and the content of this specification of the present disclosure still fall within the scope of the patent of the present disclosure.

What is claimed is:

1. A breast shaping device, designed to be placed inside a bra of a user and being configured for contact with breasts next to the bra, wherein the breast shaping device comprises:

a saccus unit, comprising a saccus, and an inflation and deflation assembly communicated to the saccus; and further comprises an elastic pad unit, wherein the elastic pad unit is configured to be arranged on one side of the saccus adjacent to the breasts, and a radian of a surface of the side of the saccus close to the breasts after inflation is configured as limited to be less than a radian of one side of the saccus away from the breasts.

2. The breast shaping device according to claim 1, wherein the elastic pad unit comprises a pair of elastic pads spaced apart from each other on the saccus.

3. The breast shaping device according to claim 2, wherein each elastic pad is a foam sheet.

4. The breast shaping device according to claim 2, wherein each elastic pad is a double-layer fabric.

5. The breast shaping device according to claim 2, wherein each elastic pad is provided with an attachment region on one side facing the breasts, and an air guide region surrounding the attachment region; a plurality of convex ribs spaced apart from each other and protruding and extending towards the breasts are arranged on the air guide region of each elastic pad; and a trench is defined between two adjacent convex ribs.

6. The breast shaping device according to claim 1, wherein the saccus of the saccus unit is provided with a first piece body and a second piece body abutted with the first piece body; the second piece body is close to the breasts relative to the first piece body for an attachment of the pair of elastic pads; the first piece body and the second piece body jointly define a pair of inflation spaces spaced apart from each other and corresponding to the breasts, and a pair of channels respectively communicated to respective corresponding inflation spaces and located between the breasts; the saccus is connected to the inflation and deflation assembly; and the inflation and deflation assembly of the saccus unit are located between the breasts and is provided with an air inlet pump and an air inlet valve which are communicated to the pair of channels and are communicated to each other, and an air release valve communicated to the saccus.

7. The breast shaping device according to claim 6, wherein the saccus is further provided with a breathable fabric; and the breathable fabric covers and fixes the second piece body of the saccus and wraps the elastic pads.

8. The breast shaping device according to claim 1, wherein the saccus of the saccus unit is provided with a pair of saccus bodies configured to be spaced apart from each other at the breasts; the saccus bodies are defined with inflation spaces; the saccus is connected to the inflation and deflation assembly; the inflation and deflation assembly of the saccus unit is provided with a pair of air inlet pumps, a pair of air inlet valves, and a pair of air release valves; the air inlet pumps are communicated to the respective corresponding air inlet valves and are arranged on the respective corresponding saccus bodies to inflate the inflation spaces of the respective corresponding saccus bodies; and the air release valves are arranged on the respective corresponding saccus bodies and are communicated to the inflation spaces of the respective corresponding saccus bodies.

9. The breast shaping device according to claim 1, wherein the saccus of the saccus unit is provided with a pair of saccus bodies configured to be spaced part from each other at the breasts; each saccus body defines an inflation space and channel which are communicated to each other; the inflation and deflation assembly of the saccus unit is provided with an air inlet pump and an air inlet valve which are communicated to each other, and a pair of air release valves; the air release valves are arranged in the channels of the respective corresponding saccus bodies; the air inlet pump and air inlet valve of the saccus unit independently inflate the respective corresponding inflation spaces through the channels of the saccus bodies; and after the inflation spaces are filled with air, the inflation spaces are closed by the respective corresponding air release valves.

10. The breast shaping device according to claim 8, wherein the saccus bodies are provided with first piece bodies and second piece bodies abutted with the first piece bodies; the second piece bodies are configured to be close to one respective corresponding breast relative to the respective corresponding first piece bodies for the attachment of the respective corresponding elastic pads; and the first piece bodies and the second piece bodies jointly define the respective corresponding inflation spaces.

11. The breast shaping device according to claim 9, wherein the saccus bodies are provided with first piece bodies and second piece bodies abutted with the first piece bodies; the second piece bodies are configured to be close to one respective corresponding breast relative to the respective corresponding first piece bodies for the attachment of the respective corresponding elastic pads; and the first piece bodies and the second piece bodies jointly define the respective corresponding inflation spaces.

12. The breast shaping device according to claim 10, wherein the saccus is further provided with a breathable fabric; and the breathable fabric covers and fixes the second piece bodies of the saccus bodies and wrap the elastic pads.

13. The breast shaping device according to claim 1, wherein the breast shaping device further comprises a plurality of air holes arranged at a bottom edge of the saccus.

* * * * *